United States Patent [19]

Stair et al.

[11] Patent Number: 4,868,563

[45] Date of Patent: Sep. 19, 1989

[54] MICROCOMPUTER CONTROLLED DISPLAY BACKLIGHT

[75] Inventors: Mark T. Stair, Delray Beach; Leonard E. Nelson, Boynton Beach, both of Fla.

[73] Assignee: Motorola, Inc., Schaumburg, Ill.

[21] Appl. No.: 101,111

[22] Filed: Sep. 25, 1987

[51] Int. Cl.[4] ..... G09G 3/18

[52] U.S. Cl. ..... 340/825.440; 340/311.1; 340/765

[58] Field of Search ..... 340/825.44, 825.48, 340/765, 784, 792, 793, 311.1; 379/56, 57; 455/38, 159; 368/67, 82, 84, 242, 227; 350/345

[56] References Cited

U.S. PATENT DOCUMENTS

| | | | |
|---|---|---|---|
| 4,104,627 | 8/1978 | Thuler | 350/345 |
| 4,498,751 | 2/1985 | Goto | 350/345 |
| 4,536,761 | 8/1985 | Tsunoda et al. | 340/825.44 |
| 4,644,350 | 2/1987 | Ishii | 340/825.44 |
| 4,713,659 | 12/1987 | Oyagi et al. | 340/825.44 |
| 4,754,275 | 6/1988 | Abbaticchio et al. | 340/825.44 |

*Primary Examiner*—Donald J. Yusko
*Assistant Examiner*—Edwin C. Holloway, III
*Attorney, Agent, or Firm*—William E. Zitelli; Vincent B. Ingrassia

[57] ABSTRACT

An apparatus for controlling the illumination of a display used to prevent messages in a pager is described. A microcomputer is used for controlling the operation of the display in response to a read switch being actuated. A light switch, coupled to an illumination circuit provides display illumination upon the light switch being manually activated. The microcomputer also couples to the light switch to allow monitoring of the switch actuation. Upon actuation of the light switch, when a message is being displayed, the microcomputer will maintain the illumination of the display, even after the light switch has been released. Once the message has been read, the microcomputer resumes monitoring the light switch, and the illumination of the display is terminated.

15 Claims, 3 Drawing Sheets

MICROCOMPUTER CONTROLLED DISPLAY BACKLIGHT

FIELD OF THE INVENTION

This invention relates generally to the field of display backlighting and more particularly to a microcomputer controlled display backlight system for use in portable communications receivers, such as selective call display paging receivers.

BACKGROUND OF THE INVENTION

Display paging receivers have been gaining wide acceptance because they provide improved informational benefit to a user compared to tone only pagers. Both numeric display pagers, which are used to present numeric data such as telephone numbers, and alphanumeric display pagers, which are used to present alphanumeric data such as "CALL HOME AT 444-9847", are available in today's market.

LCD displays are generally used to present for viewing the received messages because they provide unlimited flexibility in formatting the presentation of the messages. Examples of such flexibility include single or multiple line displays, and seven or fourteen segment character formats. A benefit of LCD displays has been the low drive power requirements, critical in a portable product having an extremely limited battery capacity. However, LCD displays are only viewable where the ambient light levels are adequate to illuminate the display. LCD displays are unviewable in low light level conditions, such as in dark rooms or in the evening and nighttime hours.

Various methods of overcoming the low light level viewing of LCD displays have been proposed. The simplest method has been to provide a light, such as incandescent lamp or electroluminescent back plane, operable by a switch to illuminate the display. The light illuminates the display for the time the switch continues to be actuated by the user. While this has provided acceptable display illumination, it has been very inconvenient when long messages must be reviewed.

Methods have been proposed to overcome the problem of manually operating the light for display illumination. One such method has been to provide a photosensor for monitoring the ambient light level, automatically turning on the light any time a message has been received and displayed. Such a method adds complexity to the design, and while the method overcomes the problem of manually operating the light switch to provide display illumination, the method has added substantially to the current drain of the receiver.

There are times when messages that have been received may be deferred for reviewing until a later time. In such instances, it is desirable to have the display lighting operational only as long as the display is activated and only when so initiated by the user. There are other times when status messages, such as the number of messages stored and memory full indications are presented on the display which the user may want to review. Again, when display illumination is required, it is desirable to provide the illumination only when so initiated by the user.

SUMMARY OF THE INVENTION

It is therefore an object of the present invention to provide a method for illuminating a display which overcomes the previously stated problems.

It is a further object of the present invention to provide display illumination only when such operation is initiated by the user.

It is a further object of the present invention to continuously provide display illumination once it has been initiated, without user intervention, as long as messages are being displayed.

In general, an apparatus for controlling the illumination of an LCD display is used to present messages received and stored in a selective call receiver. A controller is used to control the operation of the selective call receiver, and display of the stored messages. A plurality of switches operably coupled to the controller are provided to control the selective call receiver operation. A read switch is used to effect the reading and presentation of stored messages. A light switch, coupled to a lamp driver, manually activates the illumination of the display. The light switch also couples to the controller which monitors its operation. When a message is being presented and the controller senses the light switch is actuated, the controller will maintain the illumination of the display after the light switch is released. After the message has been read, the controller resumes monitoring the light switch, and the display illumination is terminated. Operation of the light switch when a message is not being displayed, will effect illumination of the display only for the time the light switch continues to be

BRIEF DESCRIPTION OF THE DRAWINGS

The features of the present invention which are believed to be novel are set forth with particularity in the appended claims. The invention, together with any further objects and advantages thereof, may be best understood by making reference to the following description taken in conjunction with the accompanying drawings, in the several figures of which like reference numerals identify identical elements, and wherein:

DESCRIPTION OF THE PREFERRED EMBODIMENT

Figure 1:
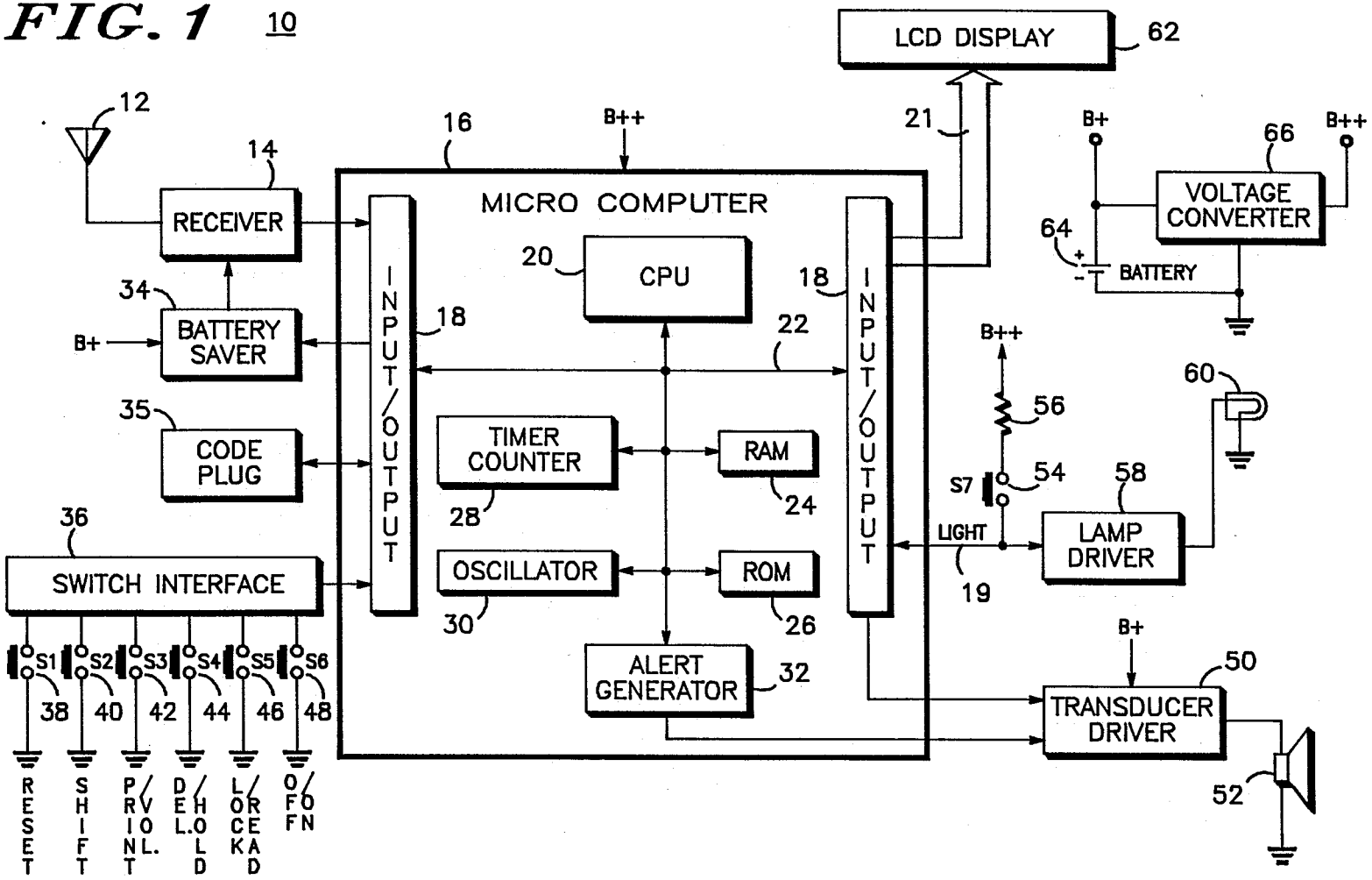
FIG. 1 is an electrical block diagram of the preferred embodiment of the present invention.

Reference is directed to FIG. 1 which shows an electrical block diagram of a selective call receiver such as a pager 10 utilizing the apparatus of the preferred embodiment of the present invention. While the present invention is described hereinafter with particular reference to a paging receiver, it is to be understood that the apparatus and methods in accordance with the present invention may be used to illuminate displays for numerous other communication receivers such as cellulr phones and the like. As shown in FIG. 1, selective call receiver 10 includes an antenna 12 and receiver 14 used to receive transmitted coded message signals. The coded message signals include selective call signalling information and message information well known to one of ordinary skill in the art. The transmitted coded message signals are detected by receiver 14, also in a manner well known in the art, and provided as an output as a serial stream of information consisting of the selective call signalling information followed by message information. The message information can be either analog such as voice, or digital such as binary encoded numeric or alphanumeric messages. The binary encoded numeric or alphanumeric messages are stored in memory, as will be described in detail shortly.

The output of receiver 14 couples to a controller means, such as microcomputer 16, through a single data input line of input/output port 18. Microcomputer 16 provides complete operational control of pager 10, providing such functions as decoding, message storage, message retrieval, display control, and alerting. In the preferred embodiment, microcomputer 16 is a single chip microcomputer, such as an MC68HC05C8 microcomputer manufactured by Motorola. Microcomputer 16 includes a CPU 20 for operational control. An internal bus 22 connects all the elements of microcomputer 16. I/0 port 18 (shown split in FIG. 1) provides a plurality of control and data lines providing communications to microcomputer 16 from externally connected circuits, such as receiver 14, switch interface 36 and LIGHT switch 54. Control of externally connected circuits, such as battery saver circuit 34, transducer driver 50, lamp driver 58, and LCD display 62 is provided by microcomputer 16. A timing means, such as a timer/counter 28 is used to generate timing intervals encountered in the operation of pager 10, such as for battery, saver timing, alert timing and message display timing. Oscillator 30 provides a clock for operation of CPU 20, and provides a reference clock for timer/counter 28. RAM 24 is used to store messages as they are received for subsequent presentation. ROM 26 contains the necessary software for controlling microcomputer 16 operation. Programs for decoding the selective call signalling information, message storage and retrieval, control of the pager operation and message presentation by switches 38-48 coupled through switch interface 36, are included in ROM 26. An alert generator 32 provides the alerting signal in response to decoding the selective call signalling information.

A code plug 35 couples to microcomputer 16 through the control lines of I/O port 18. Code plug 35, which may be an EEPROM (Electrically Erasable Programmable Read Only Memory) stores one or more predetermined addresses to which pager 10 is responsive. When the transmitted selective call signalling information is received, it is decoded by microcomputer 16 in a manner well known to one of ordinary skill in the art. When the transmitted selective call signalling information matches any one of the stored predetermined address information, the subsequently received message is stored in RAM 24 and an alerting signal is generated by alert generator 32. The alerting signal generated by alert generator 32 is coupled to transducer driver 50 which drives transducer 52, delivering an audible alert. Other forms of sensible alerting, such as a tactile or vibrating alert, can also be provided. A second control line from I/0 port 18 is used to control the delivery of the alerting signal by transducer driver 50. This control line allows such control as disabling the delivery of the alerting signal when silent operation is selected, and interrupting the alerting signals to provide distinctly different alerting signals for each predetermined address.

Switch interface 36 provides the interface required to operably couple switches 38-46 to microcomputer 16 through corresponding control lines of I/0 18, thereby providing control of pager operation through the switches. In the preferred embodiment, SHIFT switch 40 allows the user to select the alternate functions for switches 42, 44 and 46, i.e. PRINT instead of VOLUME (VOL.), DELETE (DEL.) instead of HOLD, and LOCK (i.e. protect a stored message) instead of READ, respectively. READ/LOCK switch 46 allows the user to read out and present on the LCD display messages stored in memory. The messages stored in memory are delivered to LCD display 62 via lines 21 connecting to I/O 18. By repeatedly actuating READ/-LOCK switch 46, any or all of the messages that have been stored in memory can be sequentially accessed for presentation. When SHIFT switch 40 is actuated prior to actuating READ/LOCK switch 46, the alternate LOCK function is activated, allowing a message that has been selected to be protected in memory, thereby preventing newly received messages from overwriting the protected message.

LIGHT switch 54 is used to manually activate the illumination means, comprising lamp driver 58 and lamp 60, when the ambient light level is too low for the user to view the LCD display 62. When LIGHT switch 54 is actuated, a first electrical voltage, the B++voltage, is coupled to the input of lamp driver 58 through resistor 56, as shown in FIG. 1. LIGHT switch 54 also operably couples to microcomputer 16 through a single control line of I/0 port 18 which is normally set as an input, allowing microcomputer 16 to monitor the operation of LIGHT switch 54.

When LIGHT switch 54 is actuated at a time when a message is not currently being read and presented, the display is illuminated only for the duration of time LIGHT switch 54 is actuated. When a message is being read and presented, and LIGHT switch 54 is actuated, microcomputer 16 senses LIGHT switch 54 being actuated through a control line 19 which is set as an input line of I/0 port 18. Control line 19 is then set to an output generating a second electrical signal enabling display illumination for the time interval a message is being read and presented, even though LIGHT switch 54 is released. Upon completion of reading the message, and providing no additional messages are being read, control line 19 is again reset to an input line, suspending the generation of the second electrical signal, thereby deactivating the display illumination.

Once microcomputer 16 has assumed control of the display illumination as described, the user is free to release LIGHT switch 54, allowing the user to select additional messages, or scroll through the currently displayed message, without having to manually maintain actuation of LIGHT switch 54 to keep the illuminator on. Should the user continue to actuate LIGHT switch 54 past the time when the read operation is completed, lamp 60 will remain illuminated until LIGHT switch 54 subsequently is released.

Messages being read are normally presented for a predetermined time interval, such as two seconds. This time interval is controlled by a timing means such as the counter/timer 28. Since LCD display 62 provides only a limited display capacity, such as two lines of sixteen characters, then long messages are presented one screen at a time. There are times when it is desirable to maintain a message on the screen longer than two seconds, or to more rapidly read the message. HOLD/DELETE switch 44 allows the user to continuously maintain the current screen until the HOLD/DELETE switch is actuated a second time. Repeatedly actuating HOLD-/DELETE switch 44 allows the user to step more rapidly through long messages until the message is presented in its entirety. The preferred embodiment allows continuous illumination of the display, regardless of the length of time the display is required.

In the preferred embodiment, when SHIFT switch 40 is actuated prior to actuating HOLD/DELETE switch 44, the alternate DELETE function is activated to allow a message that has been selected to be removed from memory. RESET switch 38 allows the user to terminate the audible alert prior to an automatic time-out. Thus, the alert may sound for as long as 20 seconds if not reset early. The reset switch further allows termination of other operations which have been selected by other switches, such as the reading and presentation of a message.

In the preferred embodiment, PRINT/VOLUME switch 42 allows the user, in the VOLUME mode, to adjust the volume level. PRINT/VOLUME switch 42 is also used to select the SILENT mode of operation, thereby inhibiting the delivery of the alert tone after a message has been received and stored in memory. When SHIFT switch 40 is actuated prior to actuating PRINT-/VOLUME switch 42, the alternate PRINT mode is selected, allowing the stored messages to be printed using an externally connected printer in place of the normal presentation on LCD display 62.

OFF/ON switch 48 controls turning on and off power to pager 10. Power for pager 10 is provided by battery 64 which supplies the B+ voltage, such as 1.3 V, shown in FIG. I. Circuits, such as receiver 14 and transducer driver 50 can be operated directly from the B+voltage. Other circuits, such as microcomputer 16, require a higher voltage for operation. The higher voltage, or B++ voltage, such as 3.0 V, is provided by voltage converter 66 shown in FIG. 1 in a manner well known by one of ordinary skill in the art.

Figure 2:
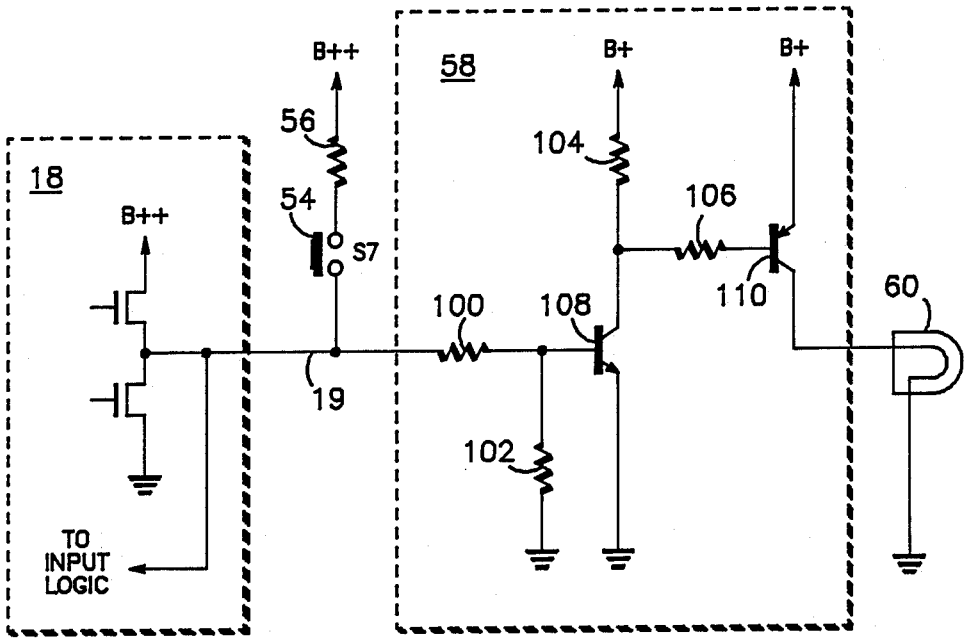
FIG. 2 is an electrical schematic diagram of the preferred embodiment of the present invention.

Reference is now directed to FIG. 2, which shows a detailed electrical schematic diagram of the illumination means including lamp driver 58 and lamp 60. When LIGHT switch 54 is not actuated, and control line 19 coupled to LIGHT switch 54 is set as an input, no input voltage is provided to the input of lamp driver 54. The input of lamp driver 54 includes a series resistor 100 and a second resistor 102 having one end coupled to ground, which are connected to the base of NPN transistor 108. With no input voltage supplied, the collector of transistor 108, which is coupled to the B+ voltage through resistor 104 is high, i.e. transistor 108 is off. The collector of transistor 108 also couples through resistor 106 to the base of PNP transistor 110. Because transistor 108 is off, the potential at the base of transistor 110 is high, therefore transistor 110 is off, and the B+ voltage is not supplied to lamp 60 which is connected to the collector of transistor 110.

When LIGHT switch 54 is actuated, a current is supplied through resistor 56 to the input of lamp driver 58, turning on transistor 108. When transistor 108 turns on, transistor 108 collector voltage goes to a low voltage, causing current to be conducted through resistor 106, turning on transistor 110. Current is then conducted through transistor 110, causing light 60 to illuminate. Actuation of light switch 54 generates a first electrical signal turning on lamp 60.

When LIGHT switch 54 was actuated as described, the first electrical signal causing lamp driver 58 to turn on lamp 60 is also sensed by control line 19 coupled to LIGHT switch 54. If microcomputer 16 determines a message is being presented while in the READ mode as previously described, control line 19 interconnecting I/0 port 18 and lamp driver 58 would then be generating a second electrical signal to maintain the input voltage to lamp driver 58. Control line 19 maintains the second electrical signal to control illumination of the lamp, even after LIGHT switch 54 is released, allowing the user the flexibility to read the current message, select different messages, freeze a message on the display, or return to a standby state, without having to manually maintain the illumination on with LIGHT switch 54.

Figure 3:
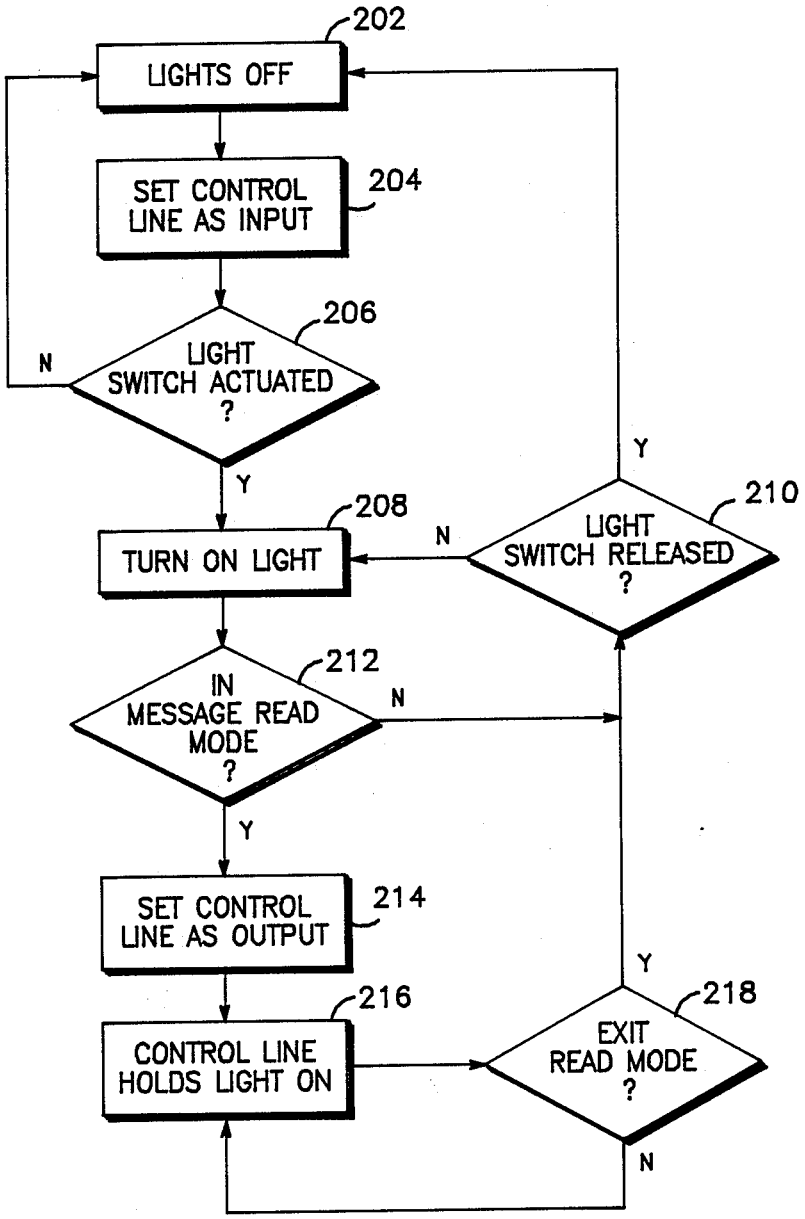
FIG. 3 is a flowchart illustrating the operation of the preferred embodiment of the present invention.

Reference is now directed to FIG. 3, which shows a flow chart illustrating the operation of the backlight illumination previously described. Initially, the light is turned off, as shown at block 202, and the control line coupling to the input of lamp driver 58 is set as an input, as shown at block 204. As long as LIGHT switch 54 is not actuated, as shown at block 206, the control line remains set to an input and the light remains off.

When LIGHT switch 54 is actuated, as shown in the yes branch from block 206, lamp 60 is turned on, as shown in block 208 in response to the first electrical signal being generated. Microcomputer 16 senses the switch being actuated through the control line and determines if the pager is in the READ mode, as shown at block 212. If the READ mode is not selected, as shown at block 212, and LIGHT switch 54 is not released, as shown at block 210, lamp 60 remains on until LIGHT switch 54 released.

If a message was being read when LIGHT switch 54 was actuated, as shown at block 212, the control line is set to an output, as shown at block 214, supplying a second electrical signal to lamp driver 58, as shown at block 216. As long as the READ mode is selected, as shown at block 218, power is supplied by the control line to maintain lamp 60 being turned on. After the message has been read and the READ mod is no longer selected, as shown at block 218, a check is made to see if LIGHT switch 54 is still actuated, as shown at block 210. If LIGHT switch 54 is not actuated, as shown at block 210, lamp 60 is extinguished.

A method and apparatus has been described which allows a user to initiate the illumination, of an LCD display while a message is being read. Once the illumination has been initiated during the READ mode, a microcomputer, through a single control line, senses the lamp being activated and assumes control of the display illumination until the read sequence is completed. The user is free to select the reading of additional messages, or to perform other operations associated with the READ mode, without having to hold the light switch depressed.

The method and apparatus described also allows the user the option of activating the display illumination at other times, such as when displayed status messages are to be read. In these instances, the illumination is provided only for as long as the user actuates the light switch, thereby conserving the pager battery.

We claim:

1. A method for illuminating a message presented on an LCD display of a selective call receiver, the selective call receiver further having a controller means and a read switch operably coupled to the controller means for effecting the presentation of the message on the display, and a light switch coupled to the controller means and to an illumination means for effecting the illumination of the display, said method comprising the steps of:

manually actuating the light switch and generating independently of said controller means a first electrical signal for the duration of the manual activation of the light switch;

illuminating the display with the illumination means by the first electrical signal independent of said controller means;

sensing the generation of the first electrical signal by the controller means during presentation of the message and, and in response thereto, generating a second electrical signal separate from said first electrical signal, solely during the presentation of the message; and maintaining the display illumination with the illumination means by the second electrical signal independent of the generation of said first electrical signal.

2. The method according the claim 1, further comprising the steps of:

sensing the first electrical signal with the controller means when the message is not being presented and inhibiting the generation of the second electrical signal in response thereto; and maintaining the display illumination while the first electrical signal is generated.

3. The method according to claim 1, said method further comprising the steps of:

actuating the read switch when a message is being presented and presenting an additional message in response thereto;

generating the second electrical signal continuously while the additional message being presented; and maintaining the display illumination while the second electrical signal is generated.

4. The method according to claim 1 wherein the selective call receiver has a hold switch operably coupled to the controller means, said method further comprising the steps of:

actuating the hold switch and continuously presenting the message in response thereto;

generating the second electrical signal continuously in response to the message being displayed; and maintaining the display illumination while the second electrical signal is generated.

5. The method according to claim 4 further comprising the steps of:

actuating the hold switch an additional time and suspending the presentation of the message in response thereto;

suspending the generation of the second electrical signal; and deactivating the display illumination in response to the second electrical signal being suspended.

6. The method according to claim 1 wherein the selective call receiver has a reset switch operably coupled to the controller means, said method further comprising the steps of:

actuating the reset switch and terminating message presentation in response thereto;

suspending the generation of the second electrical signal; and deactivating the display illumination in response to the second electrical signal being suspended.

7. The method according to claim 1 wherein the selective call receiver further includes timing means for generating a time interval during which the message is presented, said method further comprising the steps of:

initializing the time means when the read switch is actuated; and generating the second electrical signal in response thereto;

illuminating the display in response to the second electrical signal;

suspending the generation of the second electrical signal when the time interval has elapsed; and deactivating the display illumination

8. An apparatus for illuminating messages presented on a display of a selective cell receiver, said apparatus comprising:

a read switch;

manually activated light switch means for generating a first electrical signal solely for the duration of when said light switch is being manually actuated;

controller means;

illumination means, responsive to the first electrical signal independent of said controller means, for illuminating the display;

said controller means, responsive to said read switch being actuated, for effecting the presentation of messages, and further operably coupled to said illumination means and light switch means and responsive to the generation of the first electrical signal by said light switch during presentation of the message for generating a second electrical signal separate from said first electrical signal solely during the presentation of the message, said illumination means being further responsive to the second electrical signal independent of the generation of the first electrical signal for maintaining the illumination of the display.

9. The apparatus according to claim 8, further comprising a hold switch operably coupled to said controller means, for effecting the continuous presentation of the message on the display, said controller means maintaining the second electrical signal continuously in response to said hold switch being actuated a first time.

10. The apparatus according to claim 9, wherein said controller means suspends the second electrical signal when said hold switch is actuated a second time.

11. The apparatus according to claim 8 further comprising a reset switch operably coupled to said controller means, for effecting the termination of the message presentation on the display, said controller means further suspending the second electrical signal in response thereto.

12. The apparatus according to claim 8 wherein said controller means further having timing means responsive to said read switch, for generating a predetermined time interval during which the message is displayed.

13. The apparatus according to claim 8 wherein said illuminating means comprises:

a lamp, for illuminating the display; and lamp driver means, coupled to said lamp and to said controller means, for energizing said lamp.

14. The apparatus according to claim 8 wherein said controller means is a microcomputer.

15. The apparatus according to claim 14 wherein said microcomputer comprises an I/O port set as an input for sensing the actuation of said light switch, said I/0 port further set as an output for generating the second electrical signal in response to said light switch being actuated.

* * * * *